US007966719B2

(12) United States Patent
Schmidt

(10) Patent No.: US 7,966,719 B2
(45) Date of Patent: Jun. 28, 2011

(54) SET HEAD

(76) Inventor: Heiko Schmidt, Lappersdorf (DE)

( * ) Notice: Subject to any disclaimer, the term of this patent is extended or adjusted under 35 U.S.C. 154(b) by 858 days.

(21) Appl. No.: 11/976,915

(22) Filed: Oct. 29, 2007

(65) Prior Publication Data

US 2008/0127483 A1 Jun. 5, 2008

(30) Foreign Application Priority Data

Oct. 29, 2006 (DE) ..... 10 2006 051 182
May 15, 2007 (DE) ..... 10 2007 022 976
Jul. 14, 2007 (DE) ..... 10 2007 032 953

(51) Int. Cl.
*B23P 11/00* (2006.01)
*B23Q 7/10* (2006.01)

(52) U.S. Cl. ..... 29/809; 29/243.56

(58) Field of Classification Search ..... 29/798, 29/809, 811.2, 814, 243.56
See application file for complete search history.

(56) References Cited

U.S. PATENT DOCUMENTS

| | | | | |
|---|---|---|---|---|
| 3,702,494 | A | 11/1972 | Munse | |
| 3,971,116 | A * | 7/1976 | Goodsmith et al. | 29/798 |
| 4,242,793 | A * | 1/1981 | Matthews et al. | 29/798 |
| 4,625,380 | A | 12/1986 | Everhard et al. | |
| 5,080,157 | A | 1/1992 | Oerter | |
| 6,578,258 | B1 * | 6/2003 | Boyer et al. | 29/798 |
| 2002/0095781 | A1 * | 7/2002 | Schmidt | 29/818 |

FOREIGN PATENT DOCUMENTS

EP 0 224 746 6/1987

* cited by examiner

*Primary Examiner* — Jermie E Cozart
(74) *Attorney, Agent, or Firm* — Welsh Flaxman & Gitler LLC

(57) ABSTRACT

A set head for setting clip nuts on workpieces by means of pushing, having at least one channel embodied in the set head, which (channel) ends at one front end of the set head in an output or mounting opening, with which the set head can be positioned for setting the clip nuts on workpieces.

25 Claims, 5 Drawing Sheets

1
1.1
1.2
2
3
4
4.1
5
5.1
5.2
6
7
8
9
10
12
13.1
13.2
16
18.1
21
A

SET HEAD

BACKGROUND OF THE INVENTION

The invention relates to a set head for mounting or setting clip nuts on workpieces by lateral pushing through relative movement between the workpiece and the respective clip nut and/or of the set head.

It is an object of the invention is to provide for a set head that enables an effective setting or mounting of so-called clip nuts on workpieces, in particular on workpieces made of a flat material.

SUMMARY OF THE INVENTION

This object is achieved by a set head for mounting or setting clip nuts on workpieces by lateral pushing through relative movement between the workpiece and the respective clip nut and/or by movement of the set head, with the set head at least having at least one channel embodied in the set head, which (channel) ends at a front end of the set head in an output or mounting opening, with which the set head can be positioned for setting the clip nuts on workpieces, with a supply position formed in a transport direction of the clip nuts within the channel before the output opening for at least one clip nut, and with means for supplying the clip nuts from an outer supply unit into the at least one channel.

Clip nuts are nuts provided with a or formed by clips, preferably bow-shaped clips for at least temporally clip fastening the nut on workpieces.

The set head according to the invention can be used quite universally, e.g. also in or under a press especially for forming workpieces from a sheet metal.

BRIEF DESCRIPTION OF THE DRAWINGS

The invention is described below in more detail based on an exemplary embodiment with reference to the drawings, in which.

DETAILED DESCRIPTION OF THE INVENTION

Figure 1:
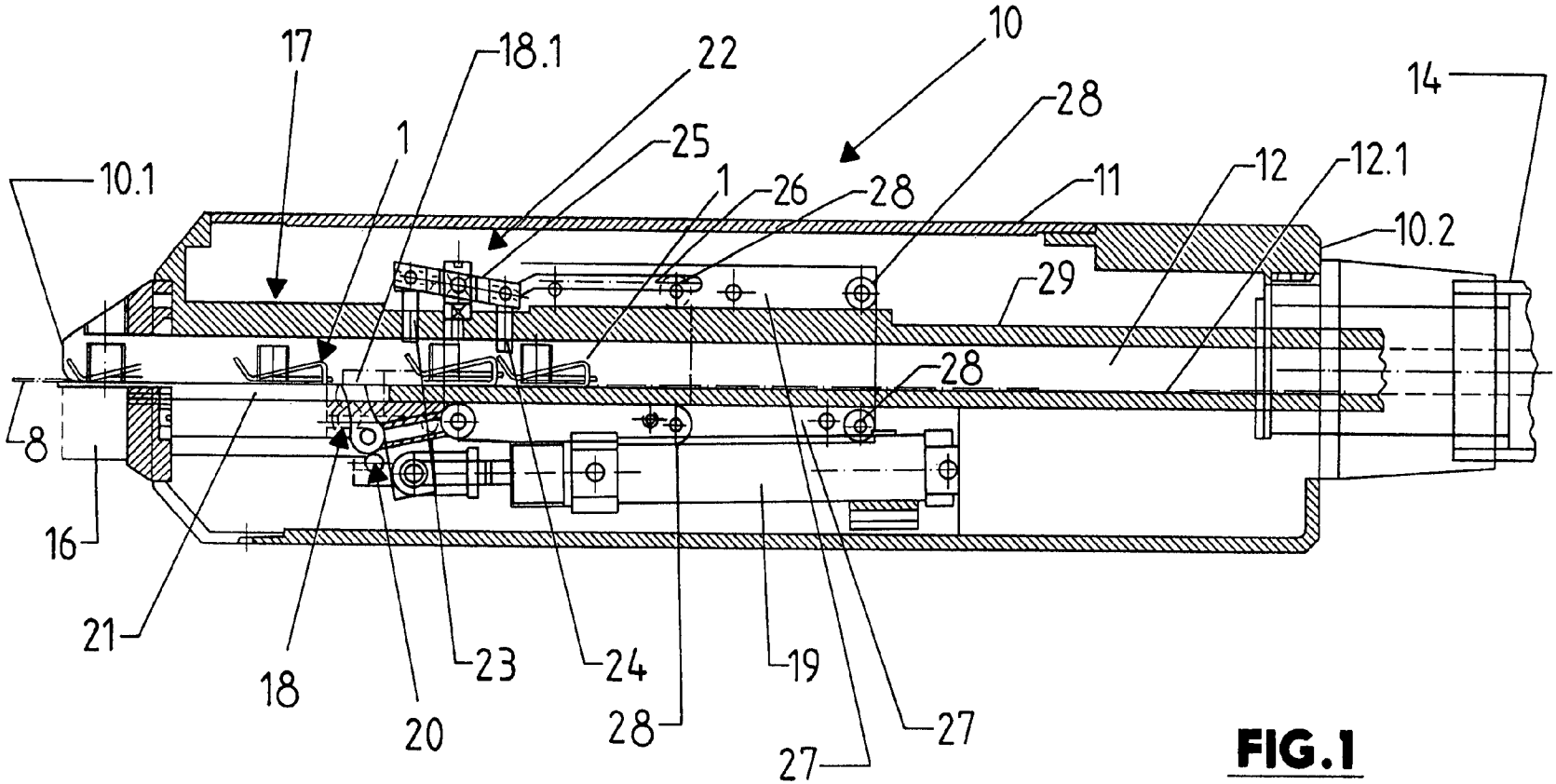
FIG. 1 is a simplified view of a set head for applying or pushing clip nuts onto workpieces.

In the drawings, 1 designates so-called clip nuts, which essentially consist of a clip 2 manufactured from spring steel and a sleeve-shaped threaded nut section 3 with inner threads on said clip. The bow-shaped clip 2 forms two leg sections 4 and 5, which are connected with each other by means of a yoke section 6 and of which the leg section 4 is designed to be flat or essentially flat. The leg section 5 is angled at its free end at 5.1 to simplify mounting. Further, the leg 5 forms a section 5.2, which in the area of the angle 5.1 is connected with the remaining leg 5 and extends parallel or essentially parallel to the leg 4 in the direction of the yoke section 6. The threaded nut section 3 is provided or formed in or onto the section 5.2. In the leg 4, on the same axis as the threaded nut section 3, an opening is provided for the passage of a screw, not depicted, engaging in the threaded nut section 3.

The leg section 5.1 and the free end 4.1 of the leg 4 opposing said section form the front end 1.1 of the clip nut 1. The rear end 1.2 of the clip nut 1 is formed by the yoke section 6 connecting the two leg sections 4 and 5.

In the drawings, 8 designates a workpiece manufactured from a flat material, for example sheet metal or sheet steel, on the edge of which one or more clip nuts 1 are mounted, in the manner that each clip nut 1 is located in the vicinity of an opening 9 provided in the workpiece 8. The clip nuts 1 are mounted by sliding them with the set head 10.

The set head 10 constitutes a housing 11 with a channel 12 for the clip nuts 1. The rectangular or square cross section of said channel is adapted to the shape of the clip nuts 1, so that the each of clip nuts 1 in the channel 12 has a pre-defined orientation, so that the clip nuts 1 are oriented with their front end 1.1 in a transport direction A, in which said nuts are moved through the channel 12. Further, the clip nuts 1 in the channel 12 are arranged so that they bear with their leg 4 on the bottom 12.1 of the channel and are moved by sliding on the guide surface 12.1 formed by said bottom through the channel 12 in transport direction A.

The channel 12 ends at the front side 10.1 of the set head depicted at the left in the drawings or at an output or mounting opening 13 there and at the rear end 10.2 of the set head 10 becomes a supply channel, which is designed as a flexible hose 14, which connects the set head 10 with a supply unit, not depicted, for the clip nuts 1.

Figures 2, 4:
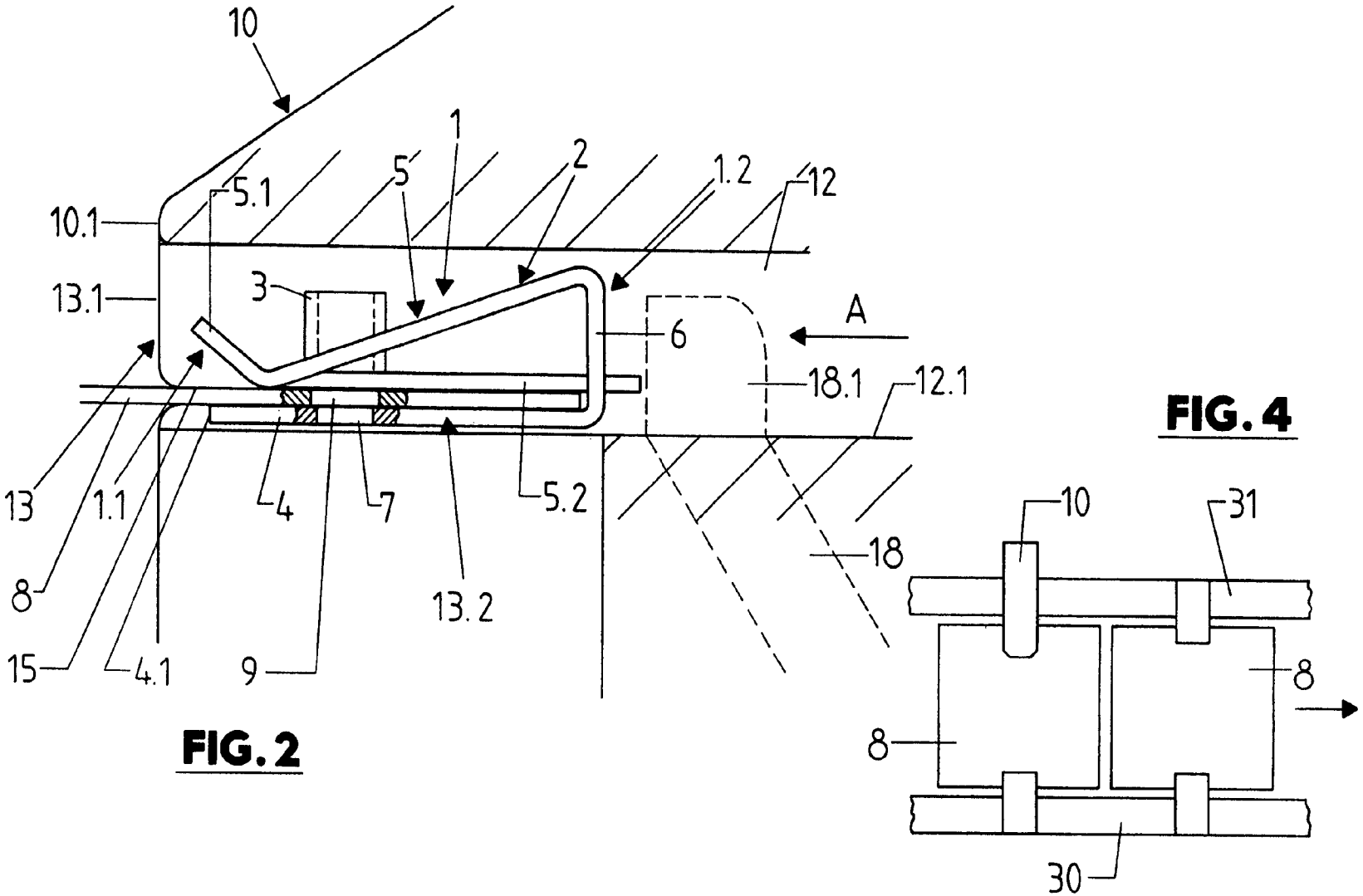
FIGS. 2 and 3 are simplified views in longitudinal cross section and in top view of the front end of the set head of FIG. 1.
FIG. 4 is a schematic view of a set head on a transfer beam of a multi-step tool for use in or under a press.
Figures 3, 5:
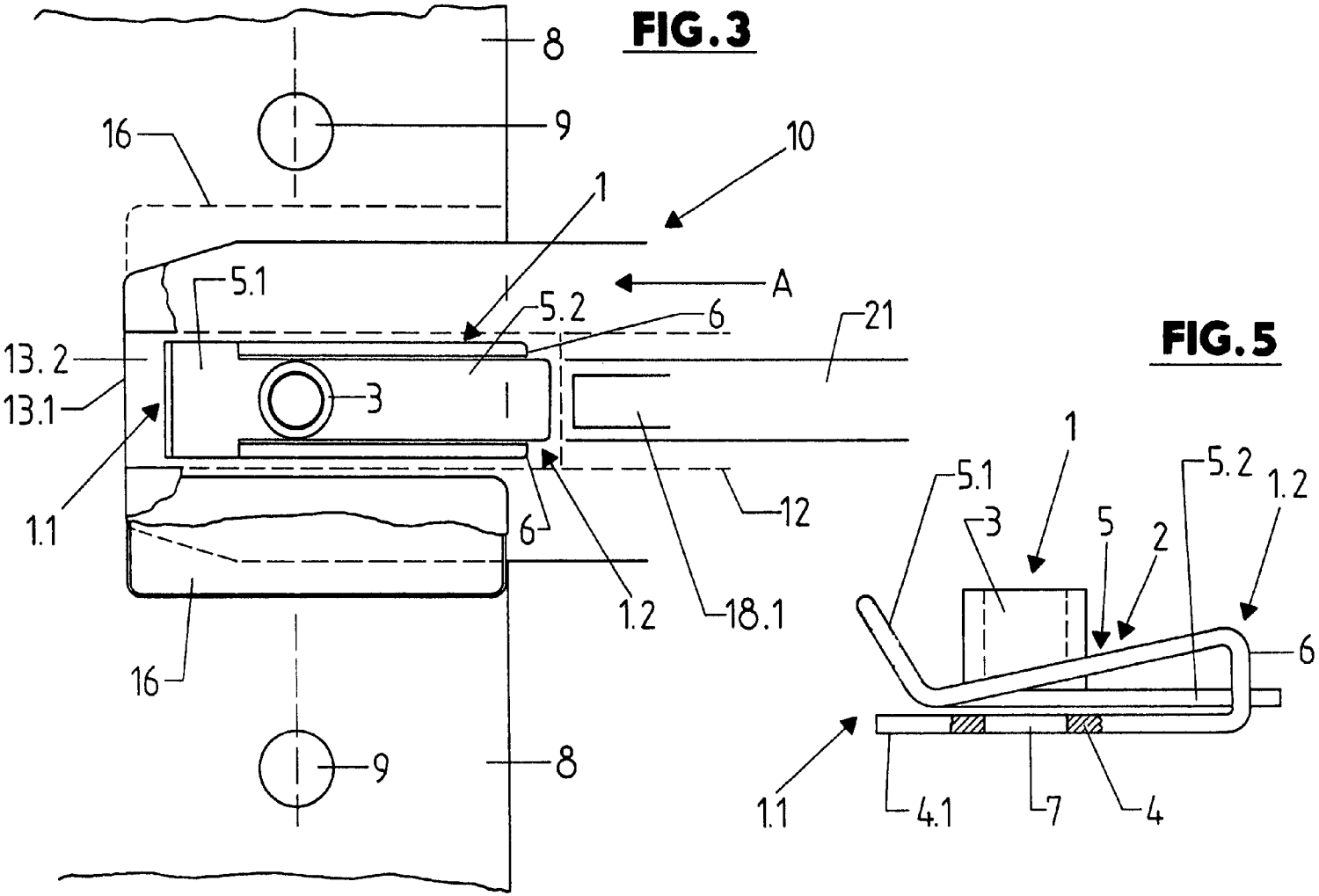
FIG. 5 is a component drawing in side view of a clip nut.

In the vicinity of the front side 10.1 of the set head or in the vicinity of the mounting or output opening 13 there, the channel 12 is open not only at its front end, but also radially toward the bottom, as depicted in FIGS. 2 and 3 with the sections 13.1 and 13.2 of the output opening 13. On both sides of the section 13.2 of the output opening 13 which (section) opens the channel 12 toward the bottom, the set head 10 forms a bearing surface 15. Each bearing surface 15 is opposed by a clamping element 16, which can be pneumatically actuated for example, so that the workpiece 8 is held and clamped with its edge area between the bearing surfaces 15 and the corresponding clamping elements 16 during mounting of the respective clip nut 1. The two bearing surfaces 15 are designed so that the side of the workpiece 8 facing away from said bearing surfaces lies in a plane that is at a distance from the plane of the guide surface 12.1 of the channel 12, namely by a dimension that is equal to or somewhat greater than the thickness of the material of the leg 4, so that the respective clip nut 1 can be pushed with the leg 4 onto the bottom of the workpiece 8.

At a supply position 17 preceding the output or mounting opening 13 in transport direction A and formed in the channel 12, a feed element is provided, in the depicted embodiment namely in the form of a feed rocker 18, which can be moved by a drive element, in the depicted embodiment namely by a pneumatic cylinder 19 and with a control array, in the depicted embodiment namely with a crank control 20, so that with each full operating stroke of the pneumatic cylinder 19 the feed rocker 18 initially located in a starting position outside of the channel 12 enters the channel 12 with its rocker head 18.1 through an opening 21 in the surface 12.1, the swing head 18.1 then moves in an operating stroke in the channel 12 in transport direction A, taking along the respective clip nut 1 located in the supply position 17 and pushes it onto the workpiece 8 fastened at the set head 10 or at the mounting opening 13 located there. Following this operating stroke the rocker head 18.1 moves through the opening 21 out of the channel 12 and returns in a return stroke to the starting position outside the channel 12.

Preceding the supply position 17 in transport direction A there is a lock or alternating lock 22 formed in the channel 12, which (lock) opens after each operating stroke of the pneumatic cylinder 19 or after each pushing of a clip nut 1, or also during said pushing, supplying or feeding a further clip nut 1 to the supply position 17 and holding back any further clip nuts 1 already transported via the supply hose 14 into the channel 12 or provided there or loaded as in a magazine. The alternating lock 22 in the depicted embodiment is formed by two rams 23 and 24, which are at a distance from each other by the length of one clip nut 1 in transport direction A, i.e. in the axis direction of the channel 12, and are moved synchronously in counter-rotation with the movement of the feed catch 18, so that whenever a ram 23 or 24 is moved radially out of the channel 12, thus clearing the channel, the other ram 24 or 23 is moved into the channel 12, thus blocking the channel 12. To achieve the counter-movement of the rams 23 and 24, said rams are linked at an end of a rocker-like lever 25, which can pivot on an axis perpendicular to the longitudinal extension of the channel 12 and perpendicular to a plane in which the axes of the rams 23 and 24 are arranged. The rocker 25 or a guide element provided on said rocker engages with a radial cam 26 formed on a slide 27, which can be moved back and forth guided in the inside of the housing 11 in the direction of the axis of the channel 12, namely by means of rollers 28 on an outer surface of a hollow profile 29 forming the channel 12. Further, the slide 27 is likewise connected by a driven linkage with the pneumatic cylinder 19.

The operating principle of the set head 10 can be described as follows:

To set a clip nut 1, the set head 10 is held with its output opening 13 on the corresponding edge area of the workpiece 8 by clamping between the bearing surfaces 15 and the clamping elements 16. A clip nut 1 is already located at the supply position 17. By activating the pneumatic cylinder 19, said clip nut is pushed from the supply position 17 onto the workpiece 8 with the feed rocker 18 or with the head 18.1. After the return movement of the feed rocker 18 to its starting position or already before the return movement, a further clip nut 1 is moved from the lock 22 to the supply position 17. The feed movement of the clip nuts 1 within the channel 12 is achieved for example by compressed air. During the operation of the set head 10, clip nuts 1 are constantly injected, i.e. by means of compressed air, via the supply hose 14, either singly or in a group, so that there is a sufficient quantity of clip nuts 1 in the channel before the lock 22.

Sensors not shown monitor the operation of the set head 10, particularly to ensure that a clip nut 1 is located at the supply position 17 before each operating stroke. The sensor then also monitors and controls the supply of the set head 10 with clip nuts 1 from the supply unit via the supply hose 14.

It was assumed above that the clip nuts 1 are loaded during operation of the set head 10 in said set head or in the guide 12 there, during which only the first of the loaded clip nuts 1 is moved to the supply position 17 by the alternating lock 22 in each operating stroke. Generally it is also possible to transport or inject the clip nuts 1 from the supply unit singly and synchronously with the operating stroke of the set head 10 directly to the supply position 17, so that the lock unit or lock 22 can be eliminated.

FIG. 4 shows in a very schematic view the transfer beams, designated 30 and 31, of a multi-step tool. A set head 10 is provided on the transfer beam 31, on which (set head) for example the mounting of the respective clip nut 1 takes place, for example during the transfer of the workpiece 8 between two stages of the tool and therefore reducing cycle times. The set head 10 can also perform the function of a clamping mechanism for the workpiece 8 provided at the corresponding area of the transfer beam. In analogy to FIG. 4 it is further possible to provide set heads 10 on so-called lifting beams of follow-on tools, in order to likewise insert clip nuts 1 into components 8 manufactured with such a tool.

Figure 6:
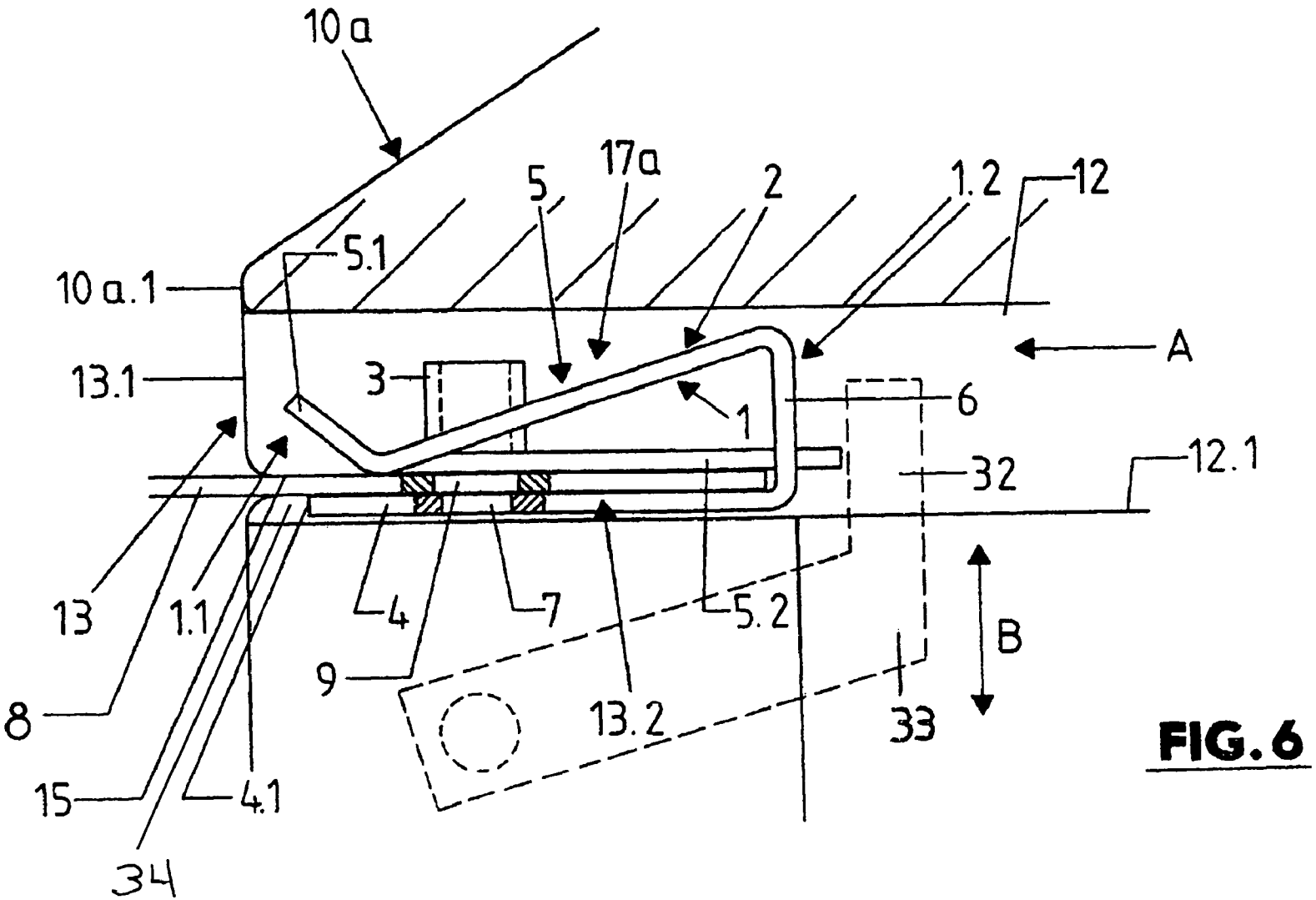
FIGS. 6 and 7 are simplified partial views of further embodiments of the set head according to the invention.

FIG. 6 shows in a simplified view the front end 10*a*.1 of a set head 10*a*, which differs from the set head 10 essentially only in that instead of a feed element pushing the respective clip nut from the supply position 17*a* onto the workpiece 8, a bearing or support element 32 is provided, against which the clip nut 1 located in the supply position 17*a* bears with its rear end 1.2 when being pushed onto the workpiece 8. The pushing of the clip nut 1 is then achieved by a relative movement between the workpiece 8 and the set head 10, for example by a corresponding feed movement of the set head 10*a* in the manner that the workpiece 8 is pushed with its edge area onto the clip nut 1. The bearing element 32 is part of a lever 33, which is pivoted (double arrow B) by a drive element synchronously with the supply of the clip nuts 1 or synchronously with the lock or alternating lock 22 (FIG. 1), also provided in this embodiment, in the supply direction (arrow A) of the clip nuts 1 before the supply position 17*a*, so that the bearing element 32 is located outside of the channel 12*a* during the feed of a clip nut to the supply position. Controlled catch means 34 stop the respective clip nut 1 transported to the supply position 17*a* by compressed air at this position. Generally it is also possible to move or advance the workpiece 8 relative to the set head 10 for pushing of the respective clip nut 1. This embodiment can be useful particularly if several clip nuts 1 are to be mounted simultaneously on a workpiece 8 by means of several set heads 10. Further, it is also possible to move or advance both the workpiece 8 and the set head 10 for pushing the respective clip nut 1.

Figure 7:
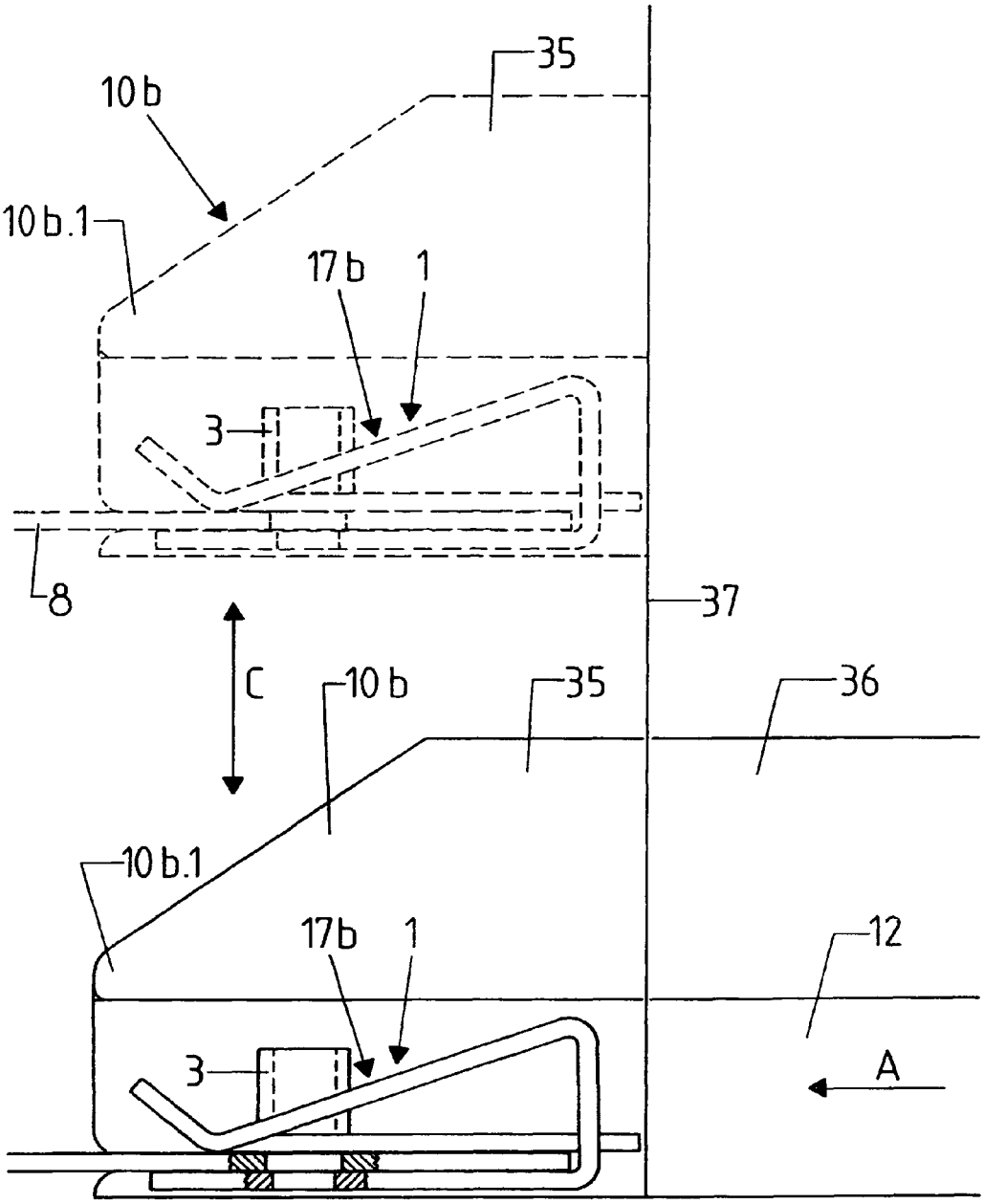

FIG. 7 shows in a very simplified schematic view as a further embodiment a set head 10*b*, which differs from the set head 10*a* in that the set head 10*b* is designed as two parts, namely consisting of a front part 35, which constitutes the front side 10*b*.1 and the supply position 17*b*.1, and a rear part 36, which also comprises the lock or alternating lock 22. The front part 35 is movable guided by a drive element, not depicted, on a guide 37 mounted on both sides of the rear part, corresponding to the double arrow C in an axis direction perpendicular to transport direction A from a loading position, in which the front part 35 forms the continuation of the rear part 36, into an operating position, which is indicated in FIG. 7 by dashed lines and in which the front part 35 is at a distance from the rear part 36, i.e. is located to the side or above the rear part 36. The operating principle of the set head 10*b* is again essentially such that a clip nut 1 is moved respectively into the supply position 17*b* in the loading position of the part 35. Afterwards, the part 35 is moved into the operating position indicated in FIG. 7 by dashed lines, in which (position) the guide 37 forms a support for the rear end 1.2 of the respective clip nut 1, so that the latter then can be pushed onto the workpiece 8 by a relative movement between the workpiece 8 and the set head 10*b*.

The set head 10*b* features the advantage that its effective length in the operating position is defined only by the axial length of the relatively short part 35, so that the set head 10*b* makes it possible to push clip nuts 1 not only on the edge area of a workpiece 8, but also for example onto the edge area, e.g. the closed edge area, of a recess formed within the workpiece 8.

The invention was described above based on exemplary embodiments. It goes without saying that further modifications and variations are possible without abandoning the underlying inventive idea upon which the invention is based.

For example, it is possible to design a feed or pushing element used for pushing the respective clip nut 1 from the supply position 17 onto the workpiece 8 so that it constantly extends into the channel 12 with its section or head that engages with the clip nuts during pushing, but evades, in a spring-mounted manner, the clip nuts 1 moving in transport direction A to the supply position 17. Further, it is possible to operate the alternating lock 22 not mechanically, but in another manner, for example pneumatically. In this case it is also possible in particular to design the feed element so that it is moved out of the channel 12 by the compressed air for the passage of the respective clip nut 1.

It was assumed above that the clamping of the set head 10 on the workpiece 8 or, alternatively, of the workpiece 8 on the set head 10 is achieved by clamping between the bearing surfaces 15 and the pneumatic clamping elements 16, which are formed for example by at least one membrane. Generally it is also possible to design these clamping elements as mechanical clamping elements.

REFERENCE LIST

1 clip nut
1.1 front end of clip nut 1
1.2 rear end of clip nut 1
2 bow or clip
3 threaded nut element
4, 5 leg
4.1 leg end
5.1 leg section
5.2 shackle made of the material of the leg 5
6 yoke section
7 opening in leg 4
8 workpiece
9 opening in workpiece
10, 10*a*, 10*b* set head
10.1, 10*a*.1, 10*b*.1 front end of set head 10
10.2 rear end of set head 10
11 housing
12 channel
12.1 guide surface or bottom of channel 12
13 output or mounting opening
13.1, 13.2 section of output opening
14 supply hose
15 bearing surface for workpiece 8
16 clamping element
17, 17*a*, 17*b* supply position
18 feed element or rocker
18.1 rocker head
19 pneumatic cylinder
20 crank control
21 opening
22 lock or alternating lock
23, 24 ram
25 rocker
26 radial cam
27 slide
28 guide rollers
29 hollow profile
30, 31 transfer beam of a multi-step tool
32 bearing or support element
33 lever
34 catch
35, 36 part of set head 10*b*
37 guide
A direction of transport
B pivot motion
C sliding motion

What is claimed is:

1. A set head for mounting or setting clip nuts on a workpiece by lateral pushing through relative movement between the workpiece and a respective clip nut or the set head, the set head comprising:

at least one channel formed in the set head, the at least one channel ends at a front end of the set head in an output opening, with which the set head can be positioned for setting the clip nuts on the workpiece, wherein the at least one channel is a straight channel along its entire length from a rear end of the set head to the output opening;

a feed element provided at a supply position within the at least one channel preceding the output opening in a transport direction (A) of the clip nuts within the channel before the output opening for at least one clip nut;

a drive element coupled to the feed element for causing movement thereof such that the feed element pushes the at least one clip nut through the output opening and onto the workpiece; and means for supplying the clip nuts from an outer supply unit into the at least one channel.

2. The set head according to claim 1, wherein the set head is positioned with its output opening for mounting the clip nuts in such a manner that a respective area of the workpiece to be provided with a clip nut extends in an axis direction of the at least one channel.

3. The set head according to claim 1, wherein the output opening is formed by a first opening sections and a second opening section, the first opening sections being a front-end or axial opening and the second opening section being a lateral or radial opening of the channel.

4. The set head according to claim 3, wherein at least one bearing surface for the workpiece is formed laterally by the second opening section.

5. The set head according to claim 4, wherein the at least one bearing surface lies in a plane approximately parallel to an axis comprised by the at least one channel at least at a transition to the output opening.

6. The set head according to claim 4, wherein the at least one channel forms a bearing surface for the clip nuts extending in a longitudinal channel direction and that the at least one bearing surface of the workpiece lies in a plane that is offset from the bearing surface of the at least one channel.

7. The set head according to claim 6, wherein the at least one bearing surface of the workpiece lies in a plane that is offset from the bearing surface of the at least one channel by a dimension that is at least equal to a material thickness of the workpiece.

8. The set head according to claim 4, wherein at least one clamping element opposing the at least one bearing surface of the workpiece is provided for clamping the workpiece between the at least one bearing surface of the workpiece and the clamping element.

9. The set head according to claim 8, wherein the clamping element is actuated pneumatically or mechanically.

10. The set head according to claim 1, wherein the feed element is formed by at least one slide or a feed catch.

11. The set head according to claim 10, wherein the feed element engages in a respective operating stroke with a section extending into the at least one channel behind the respective clip nut located at the supply position and moves said clip nut by sliding in the direction of the output opening.

12. The set head according to claim 11, wherein the feed element or the section of the feed element that engages with the clip nuts is moved from a position outside the at least one channel into said at least one channel at the beginning of each operating stroke and is moved out of the at least one channel at the end of each operating stroke.

13. The set head according to claim 11, wherein the feed element, at least on the section of the feed element engaging with the clip nuts or section extending into the at least one channel evades the clip nuts as they move by.

14. The set head according to claim 13, wherein the feed element constantly extends with the section of the feed element engaging with the clip nuts into the at least one channel.

15. The set head according to claim 11, wherein the section of the feed element engaging with the clip nuts is formed by a spring-mounted or spring-loaded movable latch or catch element.

16. The set head according to claim 15, wherein the at least one bearing or support element enables a movement of the respective clip nut into the supply position, but prevents evasion of said clip nut during mounting or setting of the clip nut.

17. The set head according to claim 15, wherein the at least one bearing or support element is movable, by a controlled drive element or by a spring.

18. The set head according to claim 1, further comprising a lock mechanism or alternating lock formed in the at least one channel in the direction of movement of the clip nuts before the supply position.

19. The set head according to claim 18, wherein the alternating lock is mechanically force controlled or pneumatically controlled.

20. The set head according to claim 1, further comprising an external supply unit for direct insertion of at least one respective clip nut to the supply position before each operating stroke of the feed element.

21. The set head according to claim 1, further comprising an external supply unit for maintaining a respective supply of several clip nuts in the set head.

22. The set head according to claim 1, further comprising at least one bearing or support element for supporting the clip nuts at the supply position during mounting or setting on the workpiece.

23. The set head according to claim 1, wherein the front end of the set head is provided with a supply position there on a set head section, which can be moved from a loading position, in which the at least one channel for supplying the clip nuts to the supply position ends, into a work position, in which the set head section constituting the supply position is at a distance from a remaining part of the set head comprising the at least one channel for supplying the clip nuts.

24. The set head according to claim 23, wherein the set head section is moved at least in an axis direction perpendicular to the longitudinal extension of the channel for supplying the clip nuts.

25. The set head according to claim 1, wherein the set head enables sliding of the at least one clip nut onto the workpiece by a relative movement between the set head and the workpiece.

* * * * *